US008583017B2

(12) United States Patent
Yamamoto et al.

(10) Patent No.: US 8,583,017 B2
(45) Date of Patent: Nov. 12, 2013

(54) FIXING DEVICE INCLUDING AN AIR SEPARATION SECTION

(75) Inventors: Koji Yamamoto, Toyokawa (JP); Hiroshi Funabiki, Uenohara (JP); Masanori Murakami, Hachioji (JP); Jinju Okuno, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 282 days.

(21) Appl. No.: 13/049,346

(22) Filed: Mar. 16, 2011

(65) Prior Publication Data

US 2011/0229220 A1 Sep. 22, 2011

(30) Foreign Application Priority Data

Mar. 19, 2010 (JP) ..... 2010-063859

(51) Int. Cl.
*G03G 15/20* (2006.01)

(52) U.S. Cl.
USPC ..... 399/323; 399/399

(58) Field of Classification Search
USPC ..... 399/323, 399
See application file for complete search history.

(56) References Cited

U.S. PATENT DOCUMENTS 6,678,496 B1 * 1/2004 Aslam et al. ..... 399/323
2007/0177913 A1 * 8/2007 Russel et al. ..... 399/323
2007/0206981 A1 * 9/2007 Amico et al. ..... 399/323
2009/0274493 A1 * 11/2009 Ishikawa et al. ..... 399/323
2011/0033214 A1 * 2/2011 Funabiki et al. ..... 399/323
2011/0091249 A1 * 4/2011 Murakami et al. ..... 399/323
2011/0097121 A1 * 4/2011 Yamamoto et al. ..... 399/323
2011/0164904 A1 * 7/2011 Hirose et al. ..... 399/323
2011/0222921 A1 * 9/2011 Murakami et al. ..... 399/323
2011/0243619 A1 * 10/2011 Wazumi et al. ..... 399/323
2012/0045260 A1 * 2/2012 Yamamoto et al. ..... 399/323
2012/0063822 A1 * 3/2012 Funabiki et al. ..... 399/323
2012/0114400 A1 * 5/2012 Wazumi et al. ..... 399/323

FOREIGN PATENT DOCUMENTS

JP 63-140571 9/1988

* cited by examiner

*Primary Examiner* — David Gray
*Assistant Examiner* — G. M. Hyder
(74) *Attorney, Agent, or Firm* — Finnegan, Henderson, Farabow, Garrett & Dunner, L.L.P.

(57) ABSTRACT

A fixing device including: a fixing member that heats toner image and fixes it onto a recording material; a pressure member that forms a nip that presses the recording material against the fixing member; a first air separating section that blows air against the fixing member and separates the recording sheet from the fixing member; and a separation claw that separates the recording material from the pressure member, wherein a tip of the separation claw contacts the pressure member at a position which is downstream, in a direction of movement of a surface of the pressure member, of a peak of an air blast pressure distribution on a surface of the pressure member, and wherein the air blast pressure distribution is formed by air blown against the pressure member which is caused by the air blown by the first air separating section against the fixing member.

7 Claims, 6 Drawing Sheets

FIXING DEVICE INCLUDING AN AIR SEPARATION SECTION

RELATED APPLICATION

This application is based on Japanese Patent Application No. 2010-63859 filed with Japanese Patent Office on Mar. 19, 2010, the entire content of which is hereby incorporated by reference.

BACKGROUND

1. Field of the Invention

The present invention relates to image forming apparatuses of the electro-photographic type, and in particular, to fixing devices that fix toner images.

2. Description of Related Art

In fixing devices of image forming apparatuses of the electro-photographic type, as a section for separating the recording material from the fixing member after fixing, there are those that use separation claws and those that use air separating section. As an example of such separating section, in Unexamined Japanese Utility Model Application Publication No. Sho 63 (1988)-140571 it has been proposed that not only the recording material is separated from the fixing member using a first separating section, but also a second separating section that aids the separation by the first separating section. An air separating section is used as the second separating section.

In the separation using a separation claw, there are problems such as the fixing member being scratched by the separation claw, etc. Even if a separation using air is used in combination as in Unexamined Japanese Utility Model Application Publication No. Sho 63 (1988)-140571, it is difficult to prevent the fixing member from getting scratched by the separation claw.

Because of this, the present inventors carried out investigations of the air separating section that separates a recording material from a fixing member by blowing air at the fixing member.

When separation using an air separating section was made, although good separation was made of recording material having a thicknesses more than common sheets such as printing paper or copying paper, the following problems occurred in the case of thin sheets with a basis weight of 60 g/m$^2$ or less.

When separating a recording material from a fixing member using an air separating section, during the separation of recording material with low rigidity such as thin sheets, it becomes necessary to increase the pressure of the air that is blown towards the fixing member. However, it becomes easy for the recording sheet that has been separated from the fixing member using a high pressure air blast to be pressed towards the pressure member side and get adhered to the pressure member. It was possible to avoid the adhering to the pressure member by providing a separation claw on the side of the pressure member. In this manner, by separating the recording sheet from the fixing member using an air separating section, and separating the recording sheet from the pressure member using a separation claw, it becomes possible to separate a thin sheet definitely from both the fixing member and the pressure member and to convey it smoothly inside the fixing device.

However, when a separation claw is provided on the side of the pressure member, it was found that string shaped undulations are formed on the recording material by the separation claw thereby lowering the quality of the copy or printed matter. The string shaped undulations, in addition, have a bad effect on the conveying of the recording material inside a finishing apparatus connected to the image forming apparatus.

The string shaped undulations are explained using FIG. 1. In FIG. 1, the white part indicates the ridge parts PA, and the hatched part indicates the valley parts PB.

The ridge part indicated by PA is the part of the recording material P that has passed a separation claw 77, and the valley part indicated by PB is the part of the recording material P that has passed between a separation claw 77 and a separation claw 77.

The recording sheet P passes over the position of a separation claw 77 while being pushed by air. Therefore, in the gap formed between a plurality of separation claws 77, the recording sheet P is pushed to a position that is lower than the separation claws 77. As a result, a high-low difference is created between the position of a separation claw 77 and the position of the gap between separation claws 77, and hence string shaped undulations are formed in the recording sheet P as is shown in FIG. 1.

The string shaped undulations of the recording sheet P formed in this manner result in lowering the quality of the printed matter in which images have been formed. Further, when a finishing apparatus has been connected to the image forming apparatus, the conveying inside a finishing apparatus connected to the image forming apparatus of the recording material in which the string shaped undulations shown in FIG. 1 is not carried out smoothly, and it becomes easy for conveying defects to occur such as jamming, etc.

SUMMARY OF THE INVENTION

An object of the present invention is not only to definitely separate a recording material from a fixing member and a pressure member, but also to prevent the formation of string shaped undulations in the recording material.

To achieve the above object, a fixing device reflecting one aspect of the present invention comprises: a fixing member that heats toner image and fixes it onto a recording material; a pressure member that forms a nip that presses the recording material against the fixing member; a first air separating section that blows air against the fixing member and separates the recording sheet from the fixing member; and a separation claw that separates the recording material from the pressure member, wherein a tip of the separation claw contacts the pressure member at a position which is downstream, in a direction of movement of a surface of the pressure member, of a peak of an air blast pressure distribution on the surface of the pressure member, and wherein the air blast pressure distribution is formed by air blown against the pressure member which is caused by the air blown by the first air separating section against the fixing member.

According to another aspect of the invention, in the fixing device, an included angle between a direction of air blown on to the fixing member by the first air separating section and a straight line connecting an inlet end point of the nip with its outlet end point is smaller than an included angle between a direction of a tangential line drawn at a point (on a surface of the fixing member, the point) which is a peak of an air blast pressure distribution on the surface of the fixing member and the straight line connecting an inlet end point of the nip with its outlet end point.

According to still another aspect of the invention, the fixing device further comprises a second air separating section that blows air onto the fixing member.

According to still another aspect of the invention, in the fixing described above, the first air separating section, during a period in which the entire recording material is passing through the fixing nip, blows air and the second air separating section blows air during only a period in which a tip portion of the recording material is passing through the fixing nip.

According to still another aspect of the invention, in the fixing device, plural of the separation claws are arranged in parallel along a direction perpendicular to a direction of conveying the recording material.

According to still another aspect of the invention, in the fixing device, the first air separating section comprises an air ejecting opening that extends over a width of the recording material along the conveying width direction.

DESCRIPTION OF THE PREFERRED EMBODIMENTS

In the following, while the present invention is explained based on some preferred embodiments, the present invention shall not be restricted to the preferred embodiments.

<Image Forming Apparatus>

Figure 2:
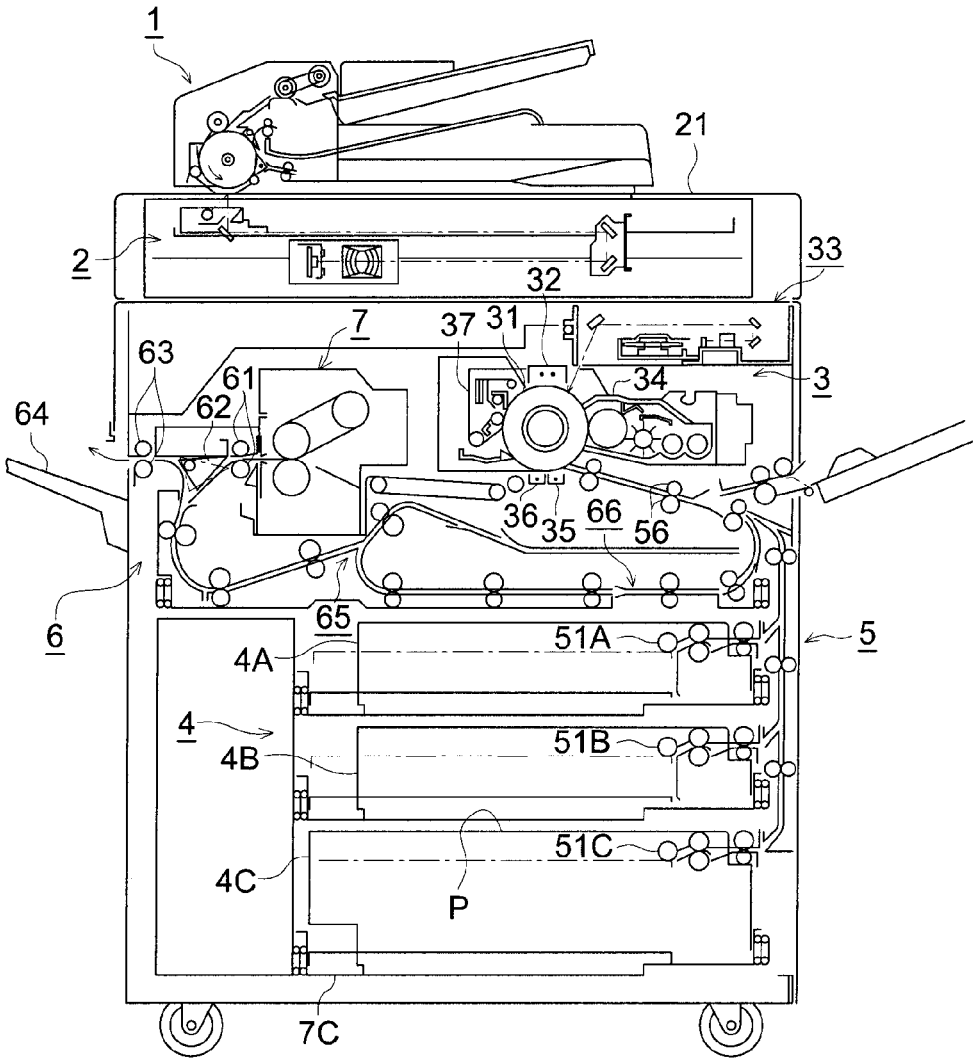
FIG. 2 is a diagram showing an entire image forming apparatus according to a preferred embodiment of the present invention.

FIG. 2 is a diagram showing an entire image forming apparatus according to a preferred embodiment of the present invention.

An image forming apparatus of the present invention has an automatic document feeding apparatus 1 and an image reading apparatus 2 in the top part, has an image forming section 3 and a fixing device 7 in the middle part, and a recording material storage section 4 in the bottom part.

The automatic document feeding apparatus 1 is an apparatus that issues one sheet of the original document at a time, conveys it to the position of reading the image of the document, and discharges the original document sheet whose image reading has been completed. The image reading apparatus 2 reads out the document issued from the document feeding apparatus 1 or the document placed on the document table 21 and outputs an image signal.

The image forming section 3 forms images on a recording material based on the image data prepared from the image signal output by the image reading apparatus 2 or based on the image data received from an external source. The image forming apparatus of the present preferred embodiment is one that forms images using an electro-photographic process. An image forming apparatus 3 has a drum shaped photoreceptor 31 which is an image carrier that has a photoconductive photoreceptor layer and carries the toner image, a charging unit 32 which uniformly charges the photoreceptor 31, a laser writing system 33 which is an exposing device that exposes the photoreceptor 31 based on the image data, a developing unit 34 that develops the latent image on the photoreceptor on the photoreceptor 31 and forms a toner image, a transfer unit 35 that transfers the toner image carried on the photoreceptor 31 onto a recording material P, a separator 36 that separates from above the photoreceptor 31 the recording material P on to which a toner image has been transferred, and a cleaning device 37 that removes the toner remaining on the photoreceptor 31 after transferring. The charging unit 32, the laser writing system 33, the developing unit 34, the transfer unit 35, the separator 36, and the cleaning unit 37 are placed along the periphery of the photoreceptor 31.

By a driving apparatus not shown in the figure, the photoreceptor 31 is rotated in the clockwise direction, and a latent image is formed on the photoreceptor 31 due to the uniform charging by the charging unit 32 and the exposure by the laser writing system 33. The formed latent image is developed by the developing unit 34 and a toner image is formed. The formed toner image is transferred to the recording material P by the transfer unit 35. The recording material P on to which a toner image has been transferred is separated from the photoreceptor 31 by the separator 36, and is conveyed to the fixing device 7. In the fixing device 7, due to the action of heat and pressure, the toner image is fixed on to the recording material P. On the other hand, the photoreceptor 31 after the toner image has been transferred on to the recording material P continues to rotate further, and is cleaned by the toner remaining on the photoreceptor 31 being removed by the cleaning unit 37.

The recording material storage section 4 stores a plurality of sheets of the recording material P in the stacked condition. The recording material storage section 4 has the recording material storage section 4A, the recording material storage section 4B, and the recording material storage section 4C.

The recording material P stored in the recording material storage section 4 is conveyed by the sheet feeding section 5 which has the issuing sections 51A to 51C which are incorporated in the first to third recording material storage sections 4A to 4C, and by a plurality of intermediate conveying rollers, and is fed to the registration roller 56. The registration roller 56 conveys the recording material P to the image transfer position constituted by the transfer unit 35 in synchronization with the image formation by the image forming section 3.

The recording material P on to which the toner image has been transferred is subjected to a fixing process by passing through the fixing device 7.

The sheet discharging and re-feeding device 6 is a conveying section that discharges outside the image forming apparatus the recording material which was conveyed by the sheet feeding section 5, and subjected to the fixing process by the fixing device 7.

The recording material P that has passed through the fixing device 7 is discharged on to a sheet discharge tray 64 by the sheet discharging rollers 63 of the sheet discharging and re-feeding device 6. During double sided image formation, the recording material P that has images formed on its first surface and that has passed through the fixing device 7 is conveyed to the re-feeding section 66, and is fed to the registration roller 56 from the re-feeding section 66. A toner image is formed on the second surface of the recording material P that was conveyed to the image transfer position by the registration roller 56, and is discharged on to the sheet discharge tray 64 after again being subjected to the fixing process.

Fixing Device (Preferred Embodiment 1)

Figure 3:
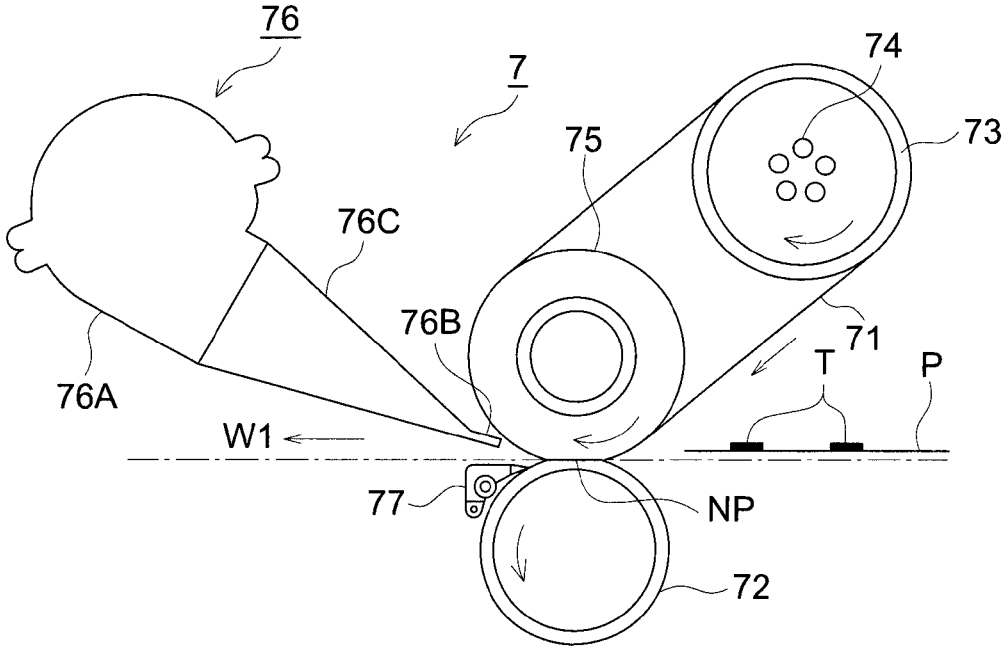
FIG. 3 is a diagram showing the configuration of a fixing device according to a first preferred embodiment of the present invention.

As is shown in FIG. 3, a fixing device 7 according the preferred embodiment 1 of the present invention has a fixing belt 71 as a fixing member, a lower pressure roller 72 as a pressure member, a heating roller 73, a heater 74, and a top pressure roller 75.

The fixing belt 71 is an endless belt having a base made of a heat resistant film such as PI (polyimide), etc., on top of which is provided an elastic layer made of a material such as silicone rubber, etc., on top of which is further provided a surface layer having good releasing property and made of a fluoroplastic material such as PFA (perfluoroalkyl vinyl ether), PTFE (polytetrafluoroethylene), etc. The lower pressure roller 72 and the top pressure roller 75 are respectively made of a roller having a metal pipe as the base, on top of which is provided an elastic layer made of a material such as silicone rubber, etc., on top of which is further provided a surface layer having good releasing property and made of a fluoroplastic material such as PFA, PTFE, etc. The lower pressure roller 72 forms the fixing nip NP of pressing and contacting the recording material P against the fixing belt 71. The heating roller 73 is made of a high thermal conductivity roller having a metal pipe as the base, on top of which is provided a surface layer having good releasing property and made of a fluoroplastic material such as PFA, PTFE, etc.

The heater 74 is made of a halogen lamp. The lower pressure roller 72 rotates as indicated by the arrow due to a drive source not shown in the figure, the fixing belt 71, the heating roller 73, and the top pressure roller 75 rotate as indicated by the arrows being driven by the lower pressure roller 72. The top pressure roller 75 is pressed against the lower pressure roller 72 due to the force from a spring not shown in the figure, and the fixing nip indicated by NP is formed.

The fixing belt 71 is heated by the heating roller 73 which is heated by the heater 74 and in turn heats the toner image T, and fixes it on to the recording material P.

The recording material P passes through the fixing nip NP as indicated by the arrow W1, and is subjected to a continuous fixing process.

The fixing device 7 further has an air separating device 76 as a first air separating section and separation claws 77. The air separating device 76 has an air blast source 76A made of a sirocco fan, a nozzle 76B that ejects air, and a duct 76C that connects the air blast source 76A and the nozzle 76B. A plurality of the separation claws 77 are arranged in parallel along a direction perpendicular to the direction of conveying the recording material. Further, the nozzle 76B has an air ejecting opening that extends over the width of the recording material along the direction perpendicular to the direction of conveying the recording material.

The recording material P that has exited the fixing nip NP formed by the fixing belt 71 and the lower pressure roller 72 is separated from the fixing belt 71 by the air ejected from the nozzle 76B. Although the recording material P has a tendency to adhere to the fixing belt 71 because its top surface, that is, the surface carrying the toner image T has the characteristics of adhering to the fixing belt 71, it is separated from the fixing belt 71 due to the air from the nozzle 76B. The recording material P separated due to the air blast is pressed against the lower pressure roller 72. The separation claws 77 separate the recording material P that has been pressed against the lower pressure roller 72 by the air blast. Depending on the material characteristics of the recording material P or the conditions of the apparatus, although the recording material P that has been pressed by the air blast has a tendency to stick to the lower pressure roller 72, even in that case, the recording material P is definitely separated by the separation claws 77.

In this manner, due to the separating action of both the air separating device 76 and the separation claws 77, the recording material P that has left the fixing nip NP is definitely separated from the fixing belt 71 and the lower pressure roller 72, and is discharged from the fixing device 7.

The separation described above, that is, the separation due to air blast and separation claws 77, is particularly effective, for example, when the recording material P is a thin sheet with a basis weight of 60 g/m$^2$ or less. In the case of thick sheets, since the rigidity of the recording material P is high, not only the recording material P separates well from the fixing belt 71, but also does not adhere to the lower pressure roller 72. On the other hand, in the case of thin sheets, since the rigidity of the recording material P is low, it can easily get adhered to the fixing belt 71. Because of this, in order to separate a thin recording material P from the fixing belt 71, it is necessary to increase the pressure of the air blast. When the pressure of the air blast is increased, the recording material P gets adhered to the lower pressure roller 72. By separating the recording material P that tends to adhere to the lower pressure roller 72 using separation claws 77, the separation is definitely made even when the recording material P is a thin sheet.

However, during the separation using air blast and separation claws, as has been described above, string shaped undulations are formed in the recording material P.

Figure 1:
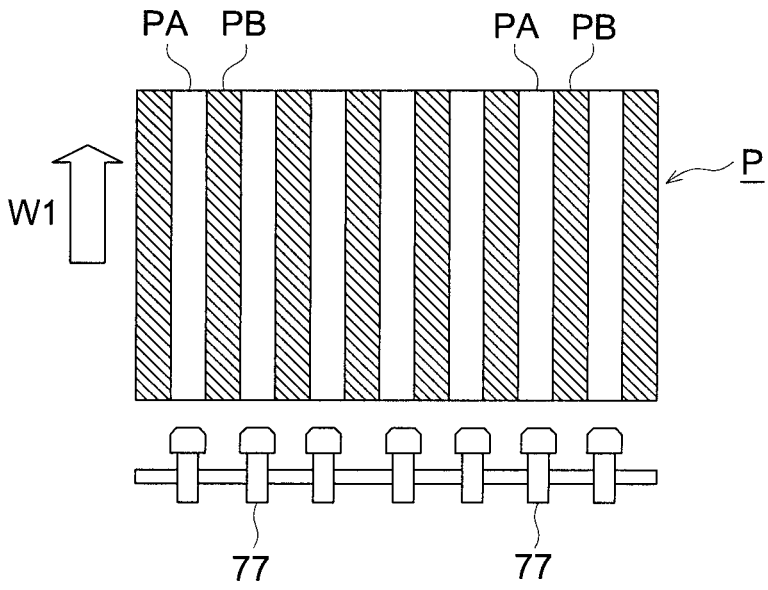
FIG. 1 is a diagram showing the string shaped undulations formed in a recording material.

The inventors of the present invention, in order to prevent the string shaped undulations shown in FIG. 1, analyzed the flow of air after being ejected from the nozzle 76B and the air blast pressure in the vicinity of the nozzle 76B. This analysis and the countermeasures obtained as a result of this analysis are explained using FIG. 1, FIG. 4, and FIG. 5.

The string shaped undulations shown in FIG. 1 are formed due to the following mechanism.

The recording material P that has separated from the fixing belt 71 due to the air blast from the air separating device 76 is pressed against the lower pressure roller 72 due to the air that has hit against the fixing belt 71 and has changed its direction. Above the lower pressure roller 72, a plurality of separation claws 77 is arranged in parallel along the conveying width direction with an interval between the separation claws 77. The recording material P that has been separated from the lower pressure roller 72 by the separation claws 77 passes over the separation claws 77. At the time of passing over the separation claws 77, the recording material P is pushed to a position lower than the height of the separation claws 77 in the intervals between the separation claws 77. As a result, the ridges PA and the valleys PB shown in FIG. 1 are formed in the recording material P at the positions of the separation claws 77 and the positions of the intervals between the separation claws 77.

Figure 4:
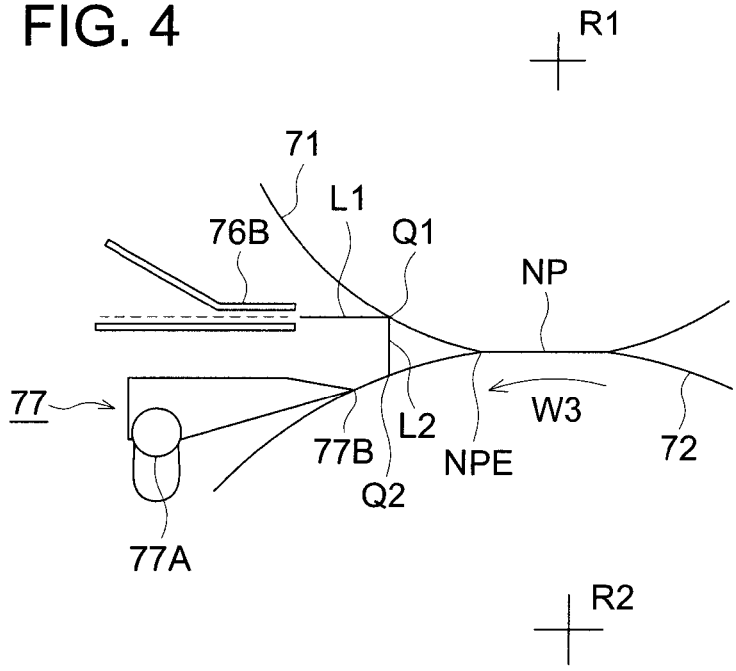
FIG. 4 is a diagram showing the positional relationship among the nozzle 76B, the fixing nip NP, and the separating pawls 77.
Figure 5:
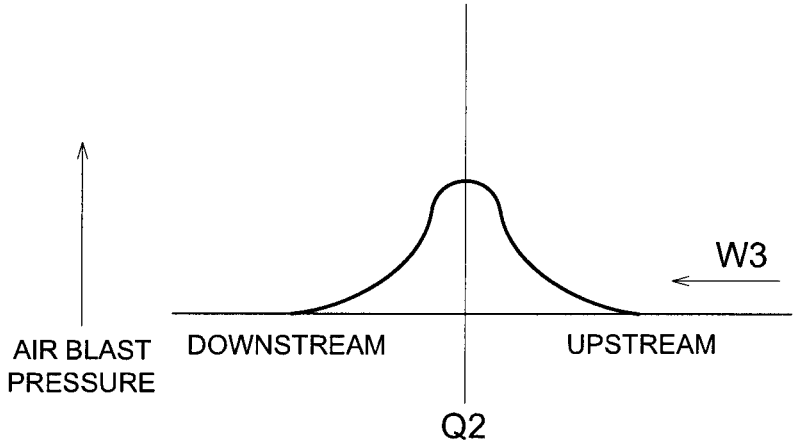
FIG. 5 is a diagram showing the air blast pressure distribution on the surface of the lower pressure roller 72.

FIG. 4 is a diagram showing the positional relationship among the nozzle 76B, the fixing nip NP, and the separating pawls 77. FIG. 5 is a diagram showing the air blast pressure distribution on the surface of the lower pressure roller 72.

The air blast pressure due to the air ejected from the nozzle 76B is the highest at the first air blowing point Q1 where the first straight line L1 passing through the center of the ejection opening of the nozzle 76B on the fixing belt 71 intersects with the fixing belt 71. In other words, the first air blowing point Q1 is the point where the air blast pressure of the air that is blown from the nozzle 76B on to the fixing belt 71 is the highest. The recording material P is separated from the fixing belt 71 at the first air blowing point Q1.

The position of the first air blowing point Q1 is set by the structure in the vicinity of the fixing nip NP and the extent of fixing of the toner image. A detailed explanation is given about the setting of the position of the first air blowing point Q1.

In order to bring the first air blowing point Q1 closer to the fixing nip NP, it is necessary to place the tip of the nozzle 76B at a position close to the fixing nip NP, and there is a structural limit to this.

Further, if the position of the first air blowing point Q1 is too far from the fixing nip NP, the duration of time that the recording material P is in contact with the fixing belt 71 becomes long, and a large amount of heat is applied to the recording material P. As a result, there are cases causing a reduction in the image quality such as excessive fixing, etc.

As a consequence, it is necessary to set the first air blowing point Q1 at an appropriate position. Although the first air blowing point Q1 varies depending on various factors such as the construction of the fixing device, etc., in one example, the first air blowing point Q1 is set at a position of 25 mm or less from the end point NPE of the fixing nip NP on the downstream side, and because of this, it was confirmed that not only good image is obtained, but also the separation of the recording material P is definitely made.

When air is blown on to the fixing belt 71 at the first air blowing point Q1, the air, after blowing against the fixing belt 71, changes direction towards the opposing lower pressure roller 72, and hits against the lower pressure roller 72 at the second air blowing point Q2. In other word, the air blown against the lower pressure roller 72 is caused by the air blown by the nozzle 76B against the fixing belt 71.

The second air blowing point Q2 is the peak of a distribution of the air blast pressure of the air that has changed direction from the fixing belt 71 and is blowing on to the lower pressure roller 72.

The positional relationship among the second air blowing point Q2, the fixing nip NP, the fixing belt 71, and the lower pressure roller 72 is explained as follows.

The second air blowing point Q2 is the point at which a second straight line L2 passing through the first air blowing point Q1 and parallel to a line connecting the axis center R1 of the top pressure roller 75 around which has been wound the fixing belt 71 intersects the surface of the lower pressure roller 72. In the example shown in the figure, the fixing belt 71 as the fixing member has been wound around the top pressure roller 75, and the pressure member is the lower pressure roller 72. In other words, in the example shown in the figure, both the fixing member and the pressure member are members having cylindrical surfaces. However, for both the fixing member and the pressure member, it is also possible to be members that are not cylindrical in shape. When members that are not cylindrical in shape are used as the fixing member and the pressure member, on the downstream end of the fixing nip NP, the center of the circle of curvature of the circular arc formed by the surface of the fixing member is defined as the axis center R1, on the downstream end of the fixing nip NP, the center of the circle of curvature of the circular arc formed by the surface of the pressure member is defined as the axis center R2.

FIG. 5 is a diagram showing the air blast pressure distribution on the surface of the lower pressure roller 72. As is shown in FIG. 5, the air blast pressure distribution on the lower pressure roller 72 becomes a distribution having its peak at the second air blowing point Q2 at which the second straight line L2 intersects with the lower pressure roller 72.

By positioning the tip 77B of the separation claw 77, that is, the position where the separation claw contacts the lower pressure roller 72 on the downstream side of the movement direction W3 of the surface of the lower pressure roller 72 further downstream than the second air blowing point Q2, the air blast pressure at the tip of the separation claw 77 becomes lower than the peak value.

Because of making the air blast pressure at the tip of the separation claw 77 lower than the peak value, the force of pressing the recording material P on the separation claw 77 becomes weak. As a result, the string shaped undulations shown in FIG. 1 will not be formed. In this manner, the formation of string shaped undulations is prevented.

This implies the following.

In addition to eject air from the air separating device 76 at a pressure necessary for definitely separating the recording member P from the fixing belt 71, it was possible to eliminate the string shaped undulations formed in the recording material due to the air blast pressure of the blown air.

Next, the desirable conditions in air separation are explained.

Figure 6:
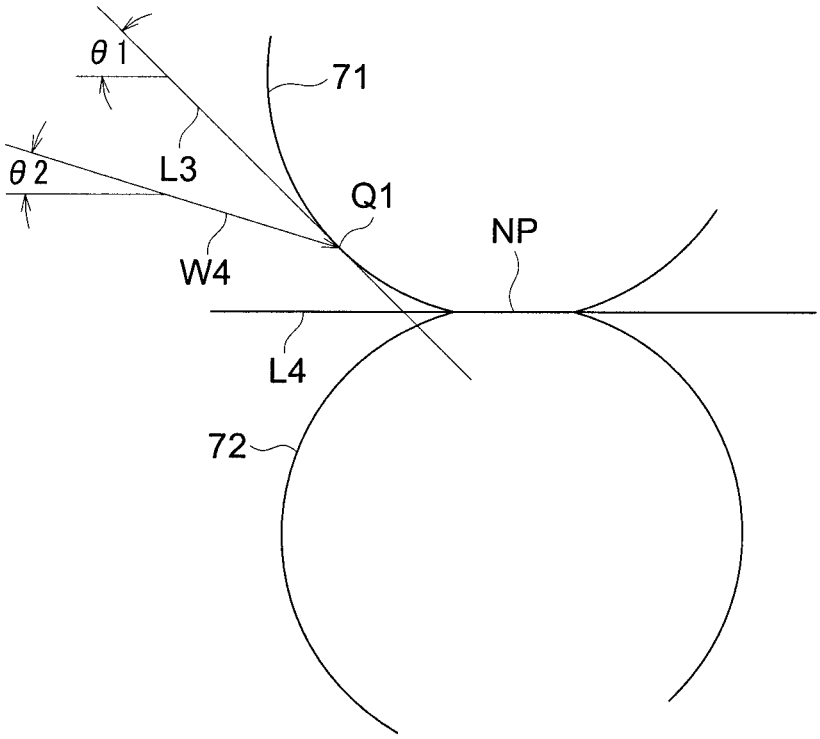
FIG. 6 is a diagram for explaining the direction of blowing air.

It is desirable that the direction of blowing air towards the fixing belt 71 is the direction indicated by W4 in FIG. 6.

The direction W4 is the direction of a straight line that intersects with the direction L4 at an included angle θ2 that is smaller than the included angle θ1 between a line L3 tangential to the fixing belt 71 at the first air blowing point Q1 and the direction L4 of the fixing nip NP. Further, the direction L4 indicating the direction of the nip NP is a straight line connecting the inlet end point of the nip NP with its outlet end point. Because of setting the direction W4 of air blast in this manner, the separation of the recording material P from the fixing belt 71 is definitely carried out.

When the direction W4 coincides with the tangential line L3, and the air is blown on to the fixing belt from the direction of the tangential line L3, the force of separating the recording material P from the fixing belt 71 is restricted to an extremely narrow range in the neighborhood of the first air blowing point Q1 and the separating action becomes weak. Further, when the direction W4 is closer to the lower pressure roller 72 than the direction of the nip NP, the recording material P is pressed to the fixing belt 71 by the air blast, and it becomes difficult to separate it from the fixing belt 71.

The air separating device 76 is positioned so that it does not obstruct the conveying of the recording material. The air blast source 76A is positioned above an extension line of the nip NP as is shown in FIG. 3, and the duct 76C connecting the air blast source 76A and the nozzle 76B positioned in the vicinity of the nip NP is positioned so that its part towards the nozzle 76B is inclined.

Figure 7:
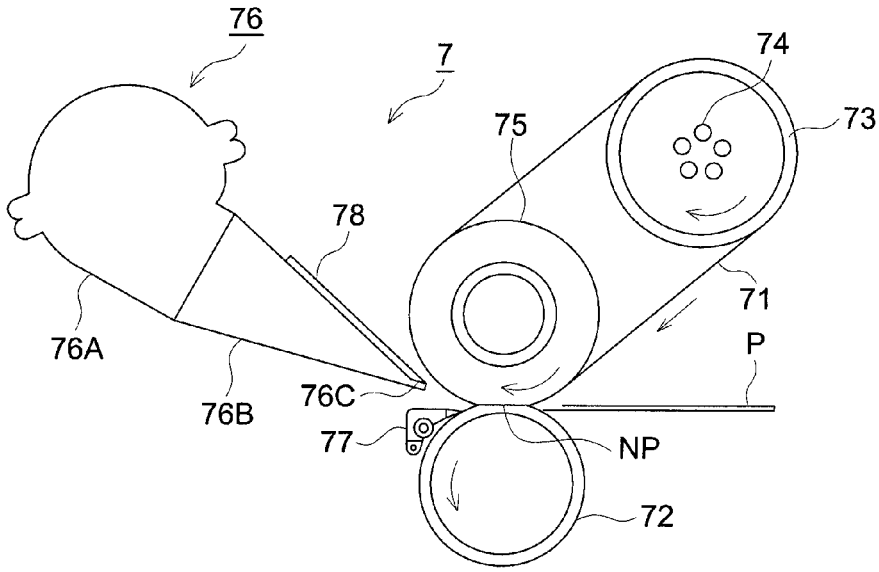
FIG. 7 is a diagram showing the configuration of a fixing device according to a second preferred embodiment of the present invention.

FIG. 7 is a diagram showing a fixing device according to a second preferred embodiment of the present invention.

The parts similar to those in FIG. 3 have been assigned similar symbols and their explanations are omitted.

In the fixing device of FIG. 7, apart from the air separating device 76 as the first air separating device, the separating device 78 has been provided as a second air separating device. The air separating device 78 is made of a compressor, and blows higher pressure air towards the fixing belt 71 than the air separating device 76.

The air separating devices 76 and 78 operate in the following manner.

The air separating device 76 operates during the entire interval of time during which the recording material P is passing and blows air against the fixing belt 71. In contrast with this, the air separating device 78 operates and blows air against the fixing belt 71 only during the interval of time during which the tip portion of the recording material P is passing through the fixing nip NP.

Figure 8:
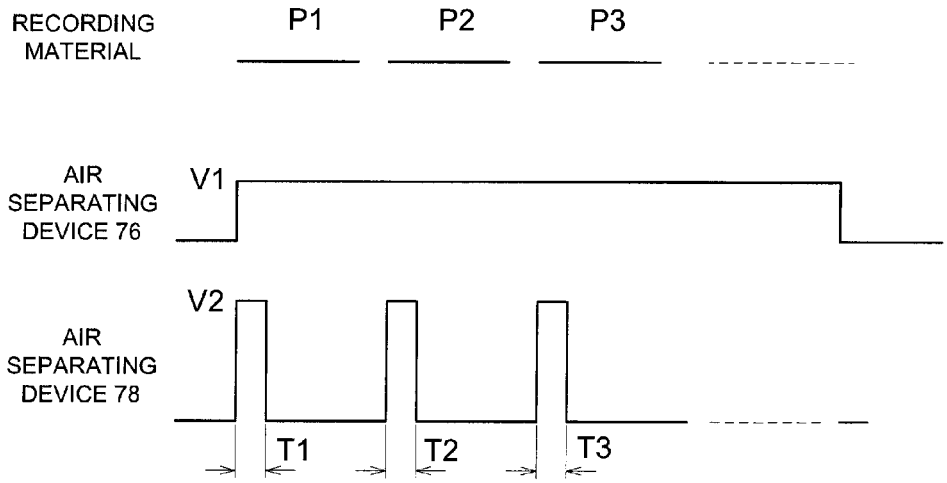
FIG. 8 is a diagram showing the operation timings of the air separating devices 76 and 78.

FIG. 8 is a timing chart showing the operations of the air separating devices 76 and 78.

The air separating device 76 becomes ON when image forming is started, and blows air on to the fixing belt 71 with an air blast pressure indicated by v1.

In contrast with this, the air separating device 78 becomes ON at the timings T1, T2, T3, . . . when the tips of the recording materials P1, P2, . . . are passing, and blows air on to the fixing belt 71 with an air blast pressure v2 which is higher than the air blast pressure v1.

Because of this type of air separation, the separation becomes even more definite.

Further, because of separation that simultaneously uses a high pressure air blast by the air separating device 78, the recording material P gets definitely separated from the fixing belt 71, and reduction in the image quality due to variations in the separating position is suppressed.

Because of simultaneous use of the air separating device 76 and the air separating device 78, it becomes possible to decrease the pressure of the air blast from the air separating device 76. Because of this, the formation of string shaped undulations in the recording material is suppressed. As a result, the degree of freedom of the design of the shape of the separation claws 77 increases.

Figure 9A:
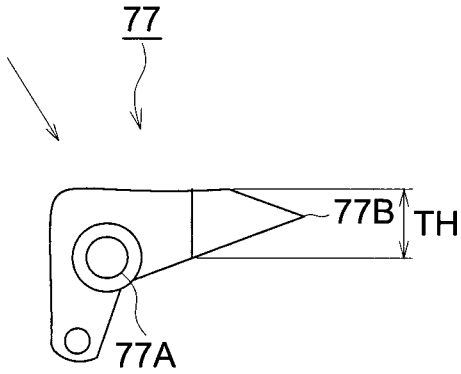
FIG. 9*a* and FIG. 9*b* are diagrams showing separating pawls 77.
Figure 9B:
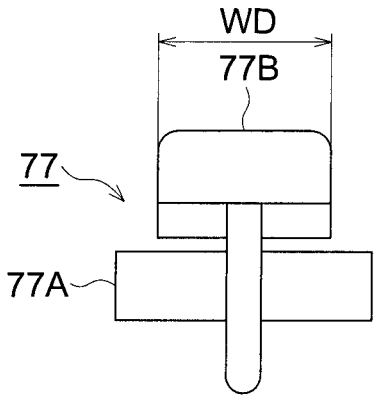

This is explained using FIG. 9. FIG. 9 is a diagram showing separating pawls 77, FIG. 9*a* is a front view diagram of a separation claw 77, and FIG. 9*b* is a diagram of the separation claw 77 when viewed from the direction of the arrow in FIG. 9*a*. By using the air separating device 78 in addition to the air separating device 76, it is possible to decrease the pressure of the air blast from the air separating device 76. Because of decreasing the pressure or the air blast, even if the thickness TH of the separation claw 77 shown in FIG. 9 is made large, or if the width WD of the tip is made narrow, string shaped undulations will not be formed. By making the thickness TH large, and making the width WD of the tip of the separation claw 77 small, the strength of the separation claw 77 is increased, and also, by making the width WD of the tip of the separation claw 77 small, the separation claws 77 are made smaller in size.

Preferred Embodiment 1

Equipment configuration: This is a fixing device shown in FIG. 3, and has the following concrete configuration.

Heating roller 73: External diameter 90 mm, PTFE coating (built in heater: 1200 W×2, 750 W×2, 500 W)

Top pressure roller 75: External diameter 90 mm, silicone rubber (10° JISA) with a thickness of 17 mm, surface layer PTFE coating Lower pressure roller 72: External diameter 90 mm, silicone rubber (10° JISA) with a thickness of 2 mm, surface layer PFA tube with a thickness of 30 μm (Built in heater: 700 W)

Fixing belt 71: External diameter 168 mm, 70 μm thick polyimide base, silicone rubber (15° JISA) with a thickness of 200 μm, surface layer PFA tube with a thickness of 30 μm Fixing load: 2000 N Belt tension: 250 N Fixing belt control temperature: 160 to 200° C.

Lottom pressure roller control temperature: 80 to 120° C.

Speed: 500 mm/s

Separation claw 77: Base material PI, surface layer PFA coating

: Tip shape R 0.05 or less, tip width WD 12 mm

: Quantity: 7

: Pawl tip position: the pawl tip is positioned at 12 mm from the outlet of the fixing nip NP (Made further away from the outlet of the fixing nip NP than the second air blowing point Q2.)

Separation supporting fan: 100 mm diameter sirocco fan×5

Rated input 38.9 W, maximum static pressure 1280 Pa

Duct opening: 60 mm×2 mm×5

Maximum discharge flow rate: 1.61 $m^3$/min

Air blast position (first air blowing point Q1 and second air blowing point Q2): 10 mm downstream from the outlet of the fixing nip NP Angle between the direction of fixing nip NP and the direction of the direction of air blast towards the fixing belt 71 θ2: 11°

Explanation is given about the case when image forming operations are made of A4 sheets at a rate of 100 ppm (100 sheets per minute).

Simultaneously with the feeding out of a sheet from sheet feeding before image transfer, the separator supporting fan is switched ON, and air is blown from the duct for supporting the separation. In the vicinity of the outlet of the fixing nip NP, an air flow with a speed of about 30 m/s has been formed from the first air blowing point Q1 towards the second air blowing point Q2.

In addition to good conveying within the fixing device of sheets from thick sheets to thin sheets, good fixing was carried out. Further, string shaped undulations were not formed on the fixed recording material.

Further, by placing the first air blowing point Q1 and the second air blowing point Q2 within a range of 10 mm from the outlet of the fixing nip NP, and by separating the recording material at these air blowing points, it was possible to carry out good fixing.

Preferred Embodiment 2

A fixing device shown in FIG. 7, that is, a fixing device 7 provided with an air separating device 76 and an air separating device 78 was used.

Nozzle of air separating device 78: 1 mm diameter×65 (5 mm pitch)

Compressor: 0.75 kW 0.8 MPa 0.00125 $m^3$/s (Reciprocating/oil-free) accumulator tank capacity 0.05 $m^3$ Directly operated solenoid valves: Capacity 0.001 $m^3$/s (100 kPa)×2

Response speed: Up to 20 ms

Air discharging time: About 50 ms (A4 horizontal, 100 ppm, passage time per sheet: 600 ms)

Image formation was made with the same other conditions as the preferred embodiment, and fixing was carried out.

As a result, not only good fixing was carried out, but also there were no formations of string shaped undulations in the recording material that had been subjected to fixing.

Comparison Example

All aspects were the same as in the preferred embodiment 1 except for the placement of the separation claws 77, the tips of the separation claws 77 were placed closer to the fixing nip NP than the second air blowing point Q2, that is, at a position of 8 mm from the outlet of the fixing nip NP, and fixing was carried out by contacting with the lower pressure roller 72.

In the comparison example, string shaped undulations were formed in the recording material that had been subjected to the fixing operation.

In the preferred embodiments of the present invention, the recording material is being separated from the fixing member using air separating devices. Therefore, it is possible to separate the recording material without scratching the surface of the fixing member. Further, in the preferred embodiments of the present invention, the tips of the separation claws are made to contact the pressure member on the downstream side rather than the peak of the air blast pressure distribution on the surface of the pressure member formed because the air from the air separating device is blown against the fixing member and changes its direction and hits against the pressure member. Because of this type of placement of the separation claws, it is possible to prevent the formation of string shaped undulations in the recording material.

What is claimed is:

1. A fixing device comprising:

a fixing member that heats toner image and fixes it onto a recording material;

a pressure member that forms a nip that presses the recording material against the fixing member;

a first air separating section that blows air against the fixing member and separates the recording sheet from the fixing member; and a separation claw that separates the recording material from the pressure member, wherein the fixing member, the pressure member, and the first air separating section are arranged so as to satisfy a positional relationship among each other in which the air blown against the fixing member changes its direction towards the pressure member, wherein a tip of the separation claw contacts the pressure member at a position which is downstream, in a direction of movement of a surface of the pressure member, of a peak of an air blast pressure distribution on the surface of the pressure member, and wherein the air blast pressure distribution is formed by air blown against the pressure member which is caused by the air blown by the first air separating section against the fixing member.

2. The fixing device according to claim 1, wherein an included angle between a direction of air blown on to the fixing member by the first air separating section and a straight line connecting an inlet end point of the nip with its outlet end point is smaller than an included angle between a direction of a tangential line drawn at a point (on a surface of the fixing member, the point) which is a peak of an air blast pressure distribution on the surface of the fixing member and the straight line connecting an inlet end point of the nip with its outlet end point.

3. The fixing device according to claim 1, further comprising a second air separating section that blows air onto the fixing member.

4. The fixing device according to claim 1, wherein plural of the separation claws are arranged in parallel along a direction perpendicular to a direction of conveying the recording material.

5. The fixing device according to claim 1, wherein the first air separating section comprises an air ejecting opening that extends over a width of the recording material along the conveying width direction.

6. An image forming apparatus provided with an image forming section that forms toner images on recording sheets, and a fixing device according to claim 1.

7. A fixing device comprising:

a fixing member that heats toner image and fixes it onto a recording material;

a pressure member that forms a nip that presses the recording material against the fixing member;

a first air separating section that blows air against the fixing member and separates the recording sheet from the fixing member;

a second air separating section that blows air against the fixing member; and a separation claw that separates the recording material from the pressure member, wherein a tip of the separation claw contacts the pressure member at a position which is downstream, in a direction of movement of a surface of the pressure member, of a peak of an air blast pressure distribution on the surface of the pressure member, wherein the air blast pressure distribution is formed by air blown against the pressure member which is caused by the air blown by the first air separating section against the fixing member, and wherein the first air separating section, during a period in which the entire recording material is passing through the fixing nip, blows air and the second air separating section blows air during only a period in which a tip portion of the recording material is passing through the fixing nip.

* * * * *